US009122205B2

(12) United States Patent
Liu et al.

(10) Patent No.: US 9,122,205 B2
(45) Date of Patent: Sep. 1, 2015

(54) PRINTING APPARATUS AND METHOD USING ELECTROHYDRODYNAMICS

(71) Applicant: Xerox Corporation, Norwalk, CT (US)

(72) Inventors: Yu Liu, Mississauga (CA); Yiliang Wu, Oakville (CA); Johann Junginger, Toronto (CA); Ping Liu, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 157 days.

(21) Appl. No.: 13/904,184

(22) Filed: May 29, 2013

(65) Prior Publication Data

US 2014/0354715 A1 Dec. 4, 2014

(51) Int. Cl.

| | |
|---|---|
| ***B41J 2/385*** | (2006.01) |
| ***B41J 2/01*** | (2006.01) |
| ***G03G 13/10*** | (2006.01) |
| ***G03G 15/10*** | (2006.01) |
| ***B41J 2/06*** | (2006.01) |

(52) U.S. Cl.

CPC . *G03G 13/10* (2013.01); *B41J 2/06* (2013.01); *G03G 15/10* (2013.01)

(58) Field of Classification Search

CPC ..... G03G 15/10; G03G 13/10; B41J 2/06
USPC ..... 347/103, 111, 1, 55; 101/153
See application file for complete search history.

(56) References Cited

U.S. PATENT DOCUMENTS

| | | | | |
|---|---|---|---|---|
| 6,312,110 | B1 | 11/2001 | Darty | |
| 6,428,148 | B1 | 8/2002 | Gore | |
| 2006/0001722 | A1 * | 1/2006 | Stelter et al. | 347/103 |
| 2011/0187798 | A1 * | 8/2011 | Rogers et al. | 347/55 |
| 2013/0092038 | A1 * | 4/2013 | Kanungo et al. | 101/153 |

FOREIGN PATENT DOCUMENTS

WO WO 2009/011709 1/2009

OTHER PUBLICATIONS

"High-resolution electrohydrodynamic jet printing" Nature Materials 6, 782-789 (2007) Published online: Aug. 5, 2007 | doi:10.1038/nmat1974.*

* cited by examiner

*Primary Examiner* — Julian Huffman
*Assistant Examiner* — Carlos A Martinez
(74) *Attorney, Agent, or Firm* — Fay Sharpe LLP

(57) ABSTRACT

An imaging apparatus includes an imaging member having a surface, a development component that is not in physical contact with the imaging member, and a power source for generating an electric field between the imaging member surface and the development component. An ink is electrohydrodynamically transferred from the development component to the imaging member surface when the electric field is generated.

20 Claims, 4 Drawing Sheets

PRINTING APPARATUS AND METHOD USING ELECTROHYDRODYNAMICS

BACKGROUND

The present disclosure relates to systems and methods for printing using an electrohydrodynamic liquid delivery method. These systems and methods can be used in conjunction with electrophotographic imaging members.

Electrophotographic or xerographic reproductions may be initiated by depositing a uniform charge on an imaging member, i.e. photoreceptor, followed by exposing the imaging member to a light image of an original document. Exposing the charged imaging member to a light image causes discharge in areas corresponding to non-image areas of the original document while the charge is maintained on image areas, creating an electrostatic latent image of the original document on the imaging member. The latent image is subsequently developed into a visible image by depositing a charged ink (i.e. toner), onto the photoconductive surface layer, such that the developing material is attracted to the charged image areas on the imaging member. Thereafter, the developing material is transferred from the imaging member to a copy sheet or some other image support substrate to which the image may be permanently affixed for producing a reproduction of the original document. In a final step in the process, the imaging member is cleaned to remove any residual developing material therefrom, in preparation for subsequent imaging cycles. However, xerographic printing has been partially constrained by its operation flexibility, printing resolution, and materials generally.

On the other hand, inkjet printing has been well known for use in printing images as well as used in the fabrication of printed circuits by directly printing components on an arbitrary blanket with few materials limitations. Recently, functional inks have been designed from organic materials and deposited for more versatile uses in energy harvesting, sensing, information display, drug discovery, MEMS devices, and other areas. Two common methods for ink-jet printing are based on thermal or acoustic formation and ejection of liquid droplets through a nozzle aperture. Conventional inkjets have a resolution limited to from about 20 to about 30 μm.

It would be desirable to develop systems and methods for applying ink to an imaging member surface which permit accurate control of the amount of the ink without degrading image quality.

BRIEF DESCRIPTION

The present disclosure relates to systems and methods for electrohydrodynamically jetting ink onto an imaging member surface. The systems and methods permit accurate control of the amount of the ink without degrading image quality.

Disclosed in embodiments is an image forming apparatus which includes an electrophotographic imaging member having a charge-retentive surface; a charging unit for applying an electrostatic charge on the charge-retentive surface to a predetermined electric potential; a light unit to discharge the electrostatic charge on the charge retentive surface to form a discharge area; a development component to apply an ink to the charge-retentive surface to form a developed image; a transfer component for transferring the developed image from the charge-retentive surface to another member or a copy substrate; an optional cleaning system to clean the imaging member surface; and a voltage bias unit for adjusting an electric field between the development component and the imaging member surface. The imaging member surface is spaced apart from the development component. The development component comprises a reservoir for containing the ink and one or more capillary openings through which the ink can be provided to the imaging member electrohydrodynamically when the electric field is generated.

The one or more capillary openings may be located from about 10 μm to about 200 μm from the imaging member surface. In some embodiments, the one or more capillary openings are located from about 50 μm to about 100 μm from the imaging member surface.

The discharged area may have a lateral resolution less than 50 μm.

The capillary openings may have an area in the range of from about 0.01 $\mu m^2$ to about 0.25 $mm^2$.

In some embodiments, the printing resolution is better than about 50 μm. The printing resolution may be between about 500 nm and about 500 μm.

The charging unit may be in contact, semi-contact, or non-contact with the imaging member surface.

In some embodiments, the electric field strength is in the range of from about 5 kV/mm to about 10 kV/mm.

The predetermined electric potential may be in the range of from about 500 V to about 1 kV/mm.

In some embodiments, the voltage bias unit is configured to simultaneously provide DC and AC voltages.

The imaging member surface may have a lower surface energy than a transfer component surface of the transfer component.

Disclosed in other embodiments is a method for providing an ink to an imaging member surface. The method includes forming an electrostatic latent image on an imaging member surface; and generating an electric field between the imaging member surface and a development component. The development component is not in physical contact with the imaging member surface. The development component includes a reservoir containing the ink and one or more capillary openings.

The electrostatic latent image may be formed by uniformly charging the imaging member surface with a charging member and selectively dissipating at least a portion of the uniformly charged surface with an image input apparatus to form the electrostatic latent image.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
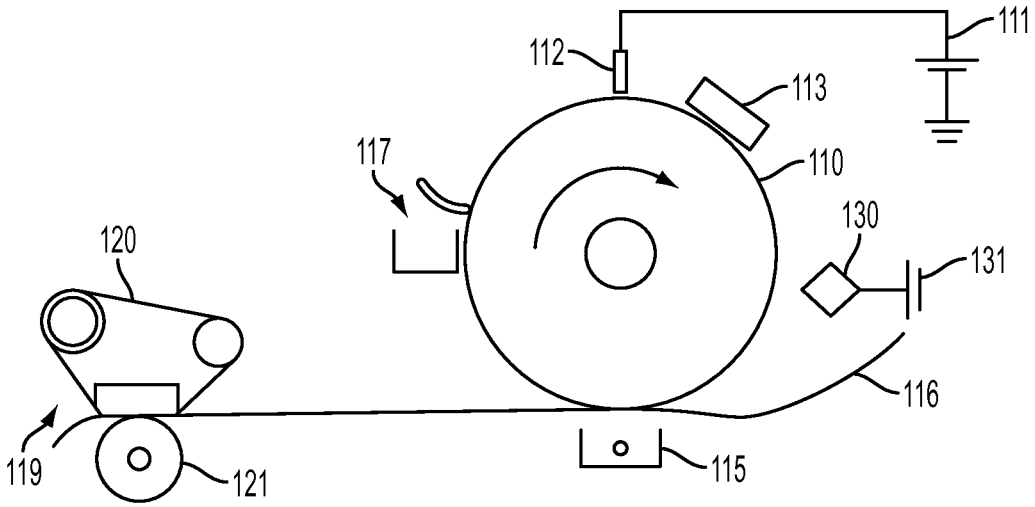
FIG. 1 illustrates an exemplary image forming apparatus of the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values). The endpoints of the ranges and any values disclosed herein are not limited to the precise range or value; they are sufficiently imprecise to include values approximating these ranges and/or values.

A value modified by a term or terms, such as "about" and "substantially," may not be limited to the precise value specified. The approximating language may correspond to the precision of an instrument for measuring the value. The modifier "about" should also be considered as disclosing the range defined by the absolute values of the two endpoints. For example, the expression "from about 2 to about 4" also discloses the range "from 2 to 4."

"Electrohydrodynamic" refers to ejecting a fluid under an electric charge applied to the orifice region of the nozzle. When the electrostatic force is sufficiently large to overcome the surface tension of the fluid at the nozzle, fluid is ejected from the nozzle.

"Ejection orifice" refers to the region of the nozzle from which the fluid is capable of being ejected under an electric charge. The "ejection area" of the ejection orifice refers to the effective area of the nozzle facing the substrate surface. In an embodiment, the ejection area corresponds to a circle, so that the diameter of the ejection orifice (D) is calculated from the ejection area (A) by: D=sqrt(4A/pi). A "substantially circular" orifice refers to an orifice having a generally smooth-shaped circumference (e.g., no distinct, sharp corners), where the minimum length across the orifice is at least 80% of the corresponding maximum length across the orifice (such as an ellipse whose major and minor diameters are within 20% of each other). "Average diameter" is calculated as the average of the minimum and maximum dimension. Similarly, other shapes are characterized as substantially shaped, such as a square, rectangle, triangle, where the corners may be curved and the lines may be substantially straight. In an aspect, substantially straight refers to a line having a maximum deflection position that is less than 10% of the line length.

"Electric charge" refers to the potential difference between the printing fluid within the nozzle (e.g., the fluid in the vicinity of the ejection orifice) and the substrate surface. This electric charge may be generated by providing a bias or electric potential to one electrode compared to a counter electrode.

A variety of efforts have been attempted for developing electrohydrodynamic printing (i.e., to use electric field to create fluid flows to deliver ink to a substrate). Although some of them have demonstrated electrohydrodynamic printing resolution down to submicron meter, flexibility to integrate nozzle array and high-speed application have not been well established. Without patterned charges on substrate, there is much higher possibility for cross-talking of ink droplets (i.e. droplets landing other than in their intended location). As a result, jetting frequency, lateral separation of the nozzle array and tip-substrate distance play coupled roles. Simultaneous jetting of multiple ink drops for this setup cannot be maximized.

The present disclosure relates to image forming apparatuses that include a development component for electrohydrodynamically applying an ink to a charge-retentive surface of an imaging member. The development component is not in physical contact with the imaging member surface (i.e., there is a gap between the development component and the imaging member surface).

Referring to FIG. 1, the structure of an imaging member using the delivery member is depicted. In the depicted embodiment, the imaging member surface 110 rotates clockwise. The charge-retentive surface of imaging member 110 is charged by a charging unit/member (e.g., a bias charging roller) 112 to which a voltage has been supplied from power supply 111. The charging unit 112 may be in contact, semi-contact, or non-contact with the imaging member surface 110. The charging unit is configured to apply an electrostatic charge on the charge-retentive surface to a predetermined electric potential (e.g., from about 500 V to about 1 kV). The imaging member is then imagewise exposed to light from an optical system or an image input apparatus 113, such as a light unit (e.g., a laser or a light emitting diode), to form an electrostatic latent image thereon. Exposure to the light selectively dissipates the charge on the imaging member surface.

The electrostatic latent image is developed by bringing a developer mixture from development component 130 into contact therewith. Development component 130 is charged by power supply/voltage bias unit 131, which in some embodiments is the same as power supply 111 which powers charging member 112. The development component 130 contains an ink which can be electrohydrodynamically applied to the imaging member surface 110 when an electric field is generated between the development component 130 and the imaging member surface 110. The development component is selectively applied to form a developed image on the imaging member surface 110. The developed image may be formed on those areas of the imaging member surface 110 which have retained a charge.

Application of an electric charge establishes an electric field that results in controllable printing of the ink on the imaging member surface. The electric charge can be applied intermittently at a given frequency. The pulsed voltage or electric charge may be a square wave, sawtooth, sinusoidal, or combinations thereof.

After the ink has been deposited on the photoconductive surface, the developed image is transferred to a copy substrate 116 by transfer component 115, which can utilize pressure transfer or electrostatic transfer. Alternatively, the developed image can be transferred to an intermediate transfer member, or bias transfer member, and subsequently transferred to a copy substrate. Examples of copy substrates include paper, transparency material such as polyester, polycarbonate, or the like, cloth, wood, or any other desired material upon which the finished image will be situated. After the transfer of the developed image is completed, copy substrate 116 advances to fusing member 119, depicted as fuser belt 120 and pressure roll 121, wherein the developed image is fused to copy substrate 116 by passing the copy substrate between the fuser belt and pressure roll, thereby forming a permanent image. Alternatively, transfer and fusing can be effected by a transfix application. The imaging member 110 then advances to cleaning station 117, wherein any remaining toner is cleaned therefrom by use of a blade, brush, or other cleaning apparatus.

A surface of the transfer component 115 may have greater surface energy than the imaging member surface.

The voltage provided by the power supply or power supplies may be provide standard line voltage(s) or other voltage levels or signal frequencies which may be desirable in accordance with other limiting factors dependent upon individual machine design. The power supply or power supplies may provide a DC voltage, an AC voltages, or combinations thereof. In some embodiments, the power supply or power supplies are configured to provide AC and DC voltages simultaneously.

The power supply or power supplies may be a high voltage power supply or power supplies. The electric field strength may be in the range of from about 5 kV/mm to about 10 kV/mm. In some embodiments, the electric field may be greater than or equal to 100 kV/m. The electric field may be calculated by dividing the applied voltage by the distance between the development component 130 and the imaging member surface 110. The distance may be from about 10 μm to about 200 μm. For example, at a distance of about 3 cm, an applied voltage of about 9 kV would generate an electric field of about 300 kV/m.

Figure 2:
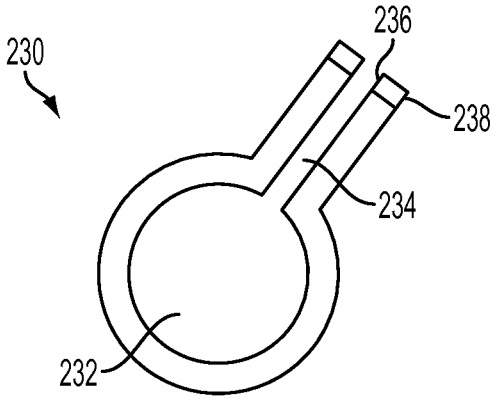
FIG. 2 illustrates an exemplary development component of the present disclosure.

FIG. 2 is a cross-sectional view showing the various parts of a development component 230 suitable for electrohydrodynamic (EHD) application of ink. The development component includes a reservoir 232 and one or more capillaries 234 extending therefrom to one or more capillary openings 236. The reservoir 232 contains the ink. When an electric field is applied between the development component 230 and a surface of the imaging member, the ink is pulled from the reservoir 232 via the one or more capillaries 234 and ejected onto the imaging member surface via the plurality of capillary openings 236. An electrode 238 can be present at the capillary opening to provide electrical charge and form the electrical field between the development component and the imaging member. Alternatively, the capillary itself can be made from a conductive material, or coated with a conductive material, that serves as an electrode. The reservoir and the capillaries can be one integral component, or can be fluidly connected to each other.

The capillary openings may have an area in the range of from about 0.01 $\mu m^2$ to about 0.25 $mm^2$. In this regard, it is desirable that the ink be released from the delivery member in the form of fine liquid droplets, rather than as a stream.

The devices and methods disclosed herein recognize that by maintaining a smaller nozzle size, the electric field can be better confined to printing placement and access smaller droplet sizes. Accordingly, in some aspects of the disclosure, the ejection orifices from which printing fluid is ejected are of a smaller dimension than the dimensions in conventional inkjet printing. In an aspect the orifice may be substantially circular, and have a diameter that is less than 30 micrometers (μm), less than 20 μm, less than 10 μm, less than 5 μm, or less than less than 1 μm. Any of these ranges are optionally constrained by a lower limit that is functionally achievable, such as a minimum dimension that does not result in excessive clogging, for example, a lower limit that is greater than 100 nm, 300 nm, or 500 nm. Other orifice cross-section shapes may be used as disclosed herein, with characteristic dimensions equivalent to the diameter ranges described. Not only do these small nozzle diameters provide the capability of accessing ejected and printed smaller droplet diameters, but they also provide for electric field confinement that provides improved placement accuracy compared to conventional inkjet printing. The combination of a small orifice dimension and related highly-confined electric field provides high-resolution printing.

Because an important feature in this system is the small dimension of the ejection orifice, the orifice is optionally further described in terms of an ejection area corresponding to the cross-sectional area of the nozzle outlet. In an embodiment, the ejection area is selected from a range that is less than 700 $\mu m^2$, or between 0.07 $\mu m^2$-0.12 $\mu m^2$ and 700 $\mu m^2$. Accordingly, if the ejection orifice is circular, this corresponds to a diameter range that is between about 0.4 μm and 30 μm. If the orifice is substantially square, each side of the square is between about 0.35 μm and 26.5 μm. In an aspect, the system provides the capability of printing features, such as single ion and/or quantum dot (e.g., having a size as small as about 5 nm).

In an embodiment, any of the systems are further described in terms of a printing resolution. The printing resolution is high-resolution, e.g., a resolution that is not possible with conventional inkjet printing known in the art without substantial preprocessing steps. In an embodiment, the resolution is better than 50 μm or 20 μm, better than 10 μm, better than 5 μm, better than 1 μm, between about 5 nm and 10 μm, between 100 nm and 10 μm, between 300 nm and 5 μm, or between about 500 nm and about 10 μm. In an embodiment, the orifice area and/or stand-off distance are selected to provide nanometer resolution, including resolution as fine as 5 nm for printing single ion or quantum dots having a printed size of about 5 nm, such as an orifice size that is smaller than 0.15 $\mu m^2$.

The discharged area may have a lateral resolution less than 50 μm.

The nozzle is made of any material that is compatible with the systems and methods provided herein. For example, the nozzle is preferably a substantially nonconducting material so that the electric field is confined in the orifice region. In addition, the material should be capable of being formed into a nozzle geometry having a small dimension ejection orifice. In an embodiment, the nozzle is tapered toward the ejection orifice. One example of a compatible nozzle material is microcapillary glass. Another example is a nozzle-shaped passage within a solid substrate, whose surface is coated with a membrane, such as silicon nitride or silicon dioxide.

Irrespective of the nozzle material, a means for establishing an electric charge to the printing fluid within the nozzle, such as fluid at the nozzle orifice or a drop extending therefrom, is required. In an embodiment, a voltage source is in electrical contact with a conducting material that at least partially coats the nozzle. The conducting material may be a conducting metal, e.g., gold, that has been sputter-coated around the ejection orifice. Alternatively, the conductor may be a non-conducting material doped with a conductor, such as an electroconductive polymer (e.g., metal-doped polymer), or a conductive plastic. In another aspect, electric charge to the printing fluid is provided by an electrode having an end that is in electrical communication with the printing fluid in the nozzle.

Any ink capable of being ionized can generally be used. For example, the ink may be made of metal-containing nanoparticles dissolved in a solvent. Alternatively, the ink can contain conventional emulsion/aggregation toner particles.

The imaging member itself may comprise a substrate 32, optional hole blocking layer 34, optional adhesive layer 36, charge generating layer 38, charge transport layer 40, and an optional overcoat layer 42. Two exemplary embodiments of an imaging member are seen in FIG. 3 and FIG. 4.

Figure 3:
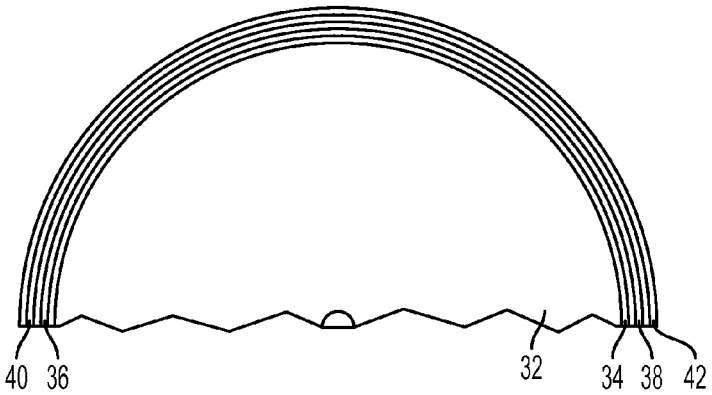
FIG. 3 is a cross-sectional view of an exemplary embodiment of a photoreceptor drum having a single charge transport layer.

The first exemplary embodiment of an imaging member that may be used in conjunction with the present disclosure is the photoreceptor drum of FIG. 3. The substrate 32 supports the other layers, and is the central portion of the drum. An optional hole blocking layer 34 can also be applied to the substrate, as well as an optional adhesive layer 36. Next, the charge generating layer 38 is applied so as to be located between the substrate 32 and the charge transport layer 40. If desired, an overcoat layer 42 may be placed upon the charge transport layer 40. Thus, either the charge transport layer or the overcoat layer will be the outermost exposed layer of the imaging member, and will provide the surface upon which the developer and functional material are applied.

Figure 4:
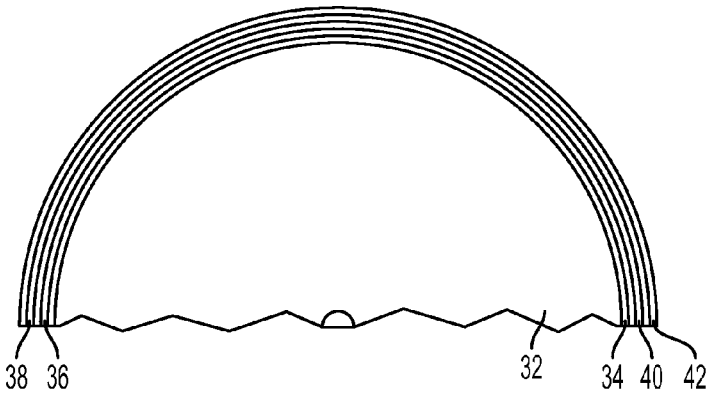
FIG. 4 is a cross-sectional view of another exemplary embodiment of a photoreceptor drum having a single charge transport layer.

Another exemplary embodiment of the photoreceptor drum of the present disclosure is illustrated in FIG. 4. This embodiment is similar to that of FIG. 3, except the locations of the charge generating layer 38 and charge transport layer 40 are reversed. Generally, the charge generating layer, charge transport layer, and other layers may be applied in any suitable order to produce either positive or negative charging photoreceptor drums.

The substrate support 32 provides support for all layers of the imaging member. It has the shape of a rigid drum and has a diameter necessary for the imaging application it will be used for. It is generally made from a conductive material, such as aluminum, copper, brass, nickel, zinc, chromium, stainless steel, aluminum, semitransparent aluminum, steel, cadmium, silver, gold, zirconium, niobium, tantalum, vanadium, hafnium, titanium, nickel, chromium, tungsten, molybdenum, indium, tin, and metal oxides.

An optional hole blocking layer 34 may be applied to the substrate 32 or coatings. Any suitable and conventional blocking layer capable of forming an electronic barrier to holes between the adjacent photoconductive layer 38 and the underlying conductive surface of substrate 32 may be used.

An optional adhesive layer 36 may be applied to the hole-blocking layer 34. Any suitable adhesive layer well known in the art may be used. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the hole blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable charge generating layer 38 may be applied which can thereafter be coated over with a contiguous charge transport layer. The charge generating layer generally comprises a charge generating material and a film-forming polymer binder resin. Charge generating materials such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof may be appropriate because of their sensitivity to white light. Vanadyl phthalocyanine, metal free phthalocyanine and tellurium alloys are also useful because these materials provide the additional benefit of being sensitive to infrared light. Other charge generating materials include quinacridones, dibromo anthanthrone pigments, benzimidazole perylene, substituted 2,4-diamino-triazines, polynuclear aromatic quinones, and the like. Benzimidazole perylene compositions are well known and described, for example, in U.S. Pat. No. 4,587,189, the entire disclosure thereof being incorporated herein by reference. Other suitable charge generating materials known in the art may also be utilized, if desired. The charge generating materials selected should be sensitive to activating radiation having a wavelength from about 600 to about 800 nm during the imagewise radiation exposure step in an electrophotographic imaging process to form an electrostatic latent image. In specific embodiments, the charge generating material is hydroxygallium phthalocyanine (OHGaPC), chiorogallium phthalocyanine (ClGaPc), or oxytitanium phthalocyanine (TiOPC).

Any suitable inactive film forming polymeric material may be employed as the binder in the charge generating layer 38, including those described, for example, in U.S. Pat. No. 3,121,006, the entire disclosure thereof being incorporated herein by reference. Typical organic polymer binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and the like.

The charge generating material can be present in the polymer binder composition in various amounts. Generally, from about 5 to about 90 percent by weight of the charge generating material is dispersed in about 10 to about 95 percent by weight of the polymer binder, and more specifically from about 20 to about 70 percent by weight of the charge generating material is dispersed in about 30 to about 80 percent by weight of the polymer binder.

The charge generating layer generally ranges in thickness of from about 0.1 micrometer to about 5 micrometers, and more specifically has a thickness of from about 0.3 micrometer to about 3 micrometers. The charge generating layer thickness is related to binder content. Higher polymer binder content compositions generally require thicker layers for charge generation. Thickness outside these ranges can be selected in order to provide sufficient charge generation.

In embodiments, the charge transport layer 40 may comprise from about 25 weight percent to about 60 weight percent of a charge transport molecule and from about 40 weight percent to about 75 weight percent by weight of an electrically inert polymer, both by total weight of the charge transport layer. In specific embodiments, the charge transport layer comprises from about 40 weight percent to about 50 weight percent of the charge transport molecule and from about 50 weight percent to about 60 weight percent of the electrically inert polymer.

Alternatively, the charge transport layer can be formed from a charge transport polymer. Any suitable polymeric charge transport polymer can be used, such as poly(N-vinylcarbazole); poly(vinylpyrene); poly(vinyltetraphene); poly (vinyltetracene), and/or poly(vinylperylene).

Optionally, the charge transport layer can include materials to improve lateral charge migration (LCM) resistance such as hindered phenolic antioxidants like, for example, tetrakis methylene(3,5-di-tert-butyl-4-hydroxy hydrocinnamate) methane (IRGANOX® 1010, available from Ciba Specialty Chemical, Tarrytown, N.Y.), butylated hydroxytoluene (BHT), and other hindered phenolic antioxidants including SUMILIZER™ BHT-R, MOP-S, BBM-S, WX-R, NW, BP-76 , BP-101, GA-80, GM, and GS (available from Sumitomo Chemical America, Inc., New York, N.Y.), IRGANOX® 1035,1076,1098,1135,1141,1222, 1330, 1425WL, 1520L, 245, 259, 3114, 3790, 5057, and 565 (available from Ciba Specialties Chemicals, Tarrytown, N.Y.), and ADEKA STAB™ AO-20, AO-30, AO-40, AO-50, AO-60, AO-70, A0-80, and AO-330 (available from Asahi Oenka Co., Ltd.); hindered amine antioxidants such as SANOL™ LS-2626, LS-765, LS-770, and LS;.744 (available from SANKYO CO., Ltd.), TINUVIN® 144 and 622LD (available from Ciba Specialties Chemicals, Tarrytown, N.Y.). MARK™ LA57, LA67. LA62, LA68, and LA63 (available from Amfine Chemical Corporation, Upper Saddle River, N.J.), and SUMILIZER® TPS (available from Sumitomo Chemical America, Inc., New York, N.Y.); thioether antioxidants such as SUMILIZER® TP-D (available from Sumitomo Chemical America, Inc., New York, N.Y.); phosphite antioxidants such as MARK™ 2112, PEP-B, PEP-24G, PEP-36, 329K, and HP-10 (available from Amfine Chemical Corporation, Upper Saddle River, N.J.); other molecules such as bis(4-diethylamino-2-methylphenyl) phenylmethane (BDETPM), bis-[2-methyl-4-(N-2-hydroxyethyl-N-ethyl-aminophenyl)]-phenylmethane (DHTPM), and the like. The charge transport layer can contain antioxidant in an amount ranging from about 0 to about 20 weight %, from about 1 to about 10 weight %, or from about 3 to about 8 weight % based on the total charge transport layer.

The charge transport layer may be considered an insulator to the extent that the electrostatic charge placed on the charge transport layer is not conducted such that formation and retention of an electrostatic latent image thereon can be prevented. On the other hand, the charge transport layer can be considered electrically "active" in that it allows the injection of holes from the hole injecting layer to be transported through the charge transport layer itself to enable selective discharge of a negative surface charge on the imaging member surface.

Generally, the thickness of the charge transport layer is from about 10 to about 100 micrometers, including from about 20 micrometers to about 60 micrometers. In general, the ratio of the thickness of the charge transport layer to the charge generating layer is in embodiments from about 2:1 to 200:1 and in some instances from about 2:1 to about 400:1. In specific embodiments, the charge transport layer is from about 10 micrometers to about 40 micrometers thick.

An overcoat layer 42, if desired, may be utilized to provide imaging member surface protection as well as improve resistance to abrasion. Overcoat layers are known in the art. Generally, they serve a function of protecting the charge transport layer from mechanical wear and exposure to chemical contaminants.

The present disclosure will further be illustrated in the following non-limiting working example, it being understood that the example is intended to be illustrative only and the disclosure is not intended to be limited to the materials, conditions, process parameters, and the like recited herein.

EXAMPLE

Dodecylamine-stabilized silver nanoparticle ink was prepared by dissolving the silver nanoparticles in decalin (40 wt %) and filtering with a 1 μm syringe.

A glass microcapillary tube having a nozzle inner diameter of about 400 μm and an outer diameter of about 600 μm was prepared. After nozzle fabrication, a conductive coating was applied on both the inner and outer nozzle surfaces to permit biasing the surface potential of the nozzle in order to allow establishment of the electric field required for electrohydrodynamic jetting.

Figure 5:
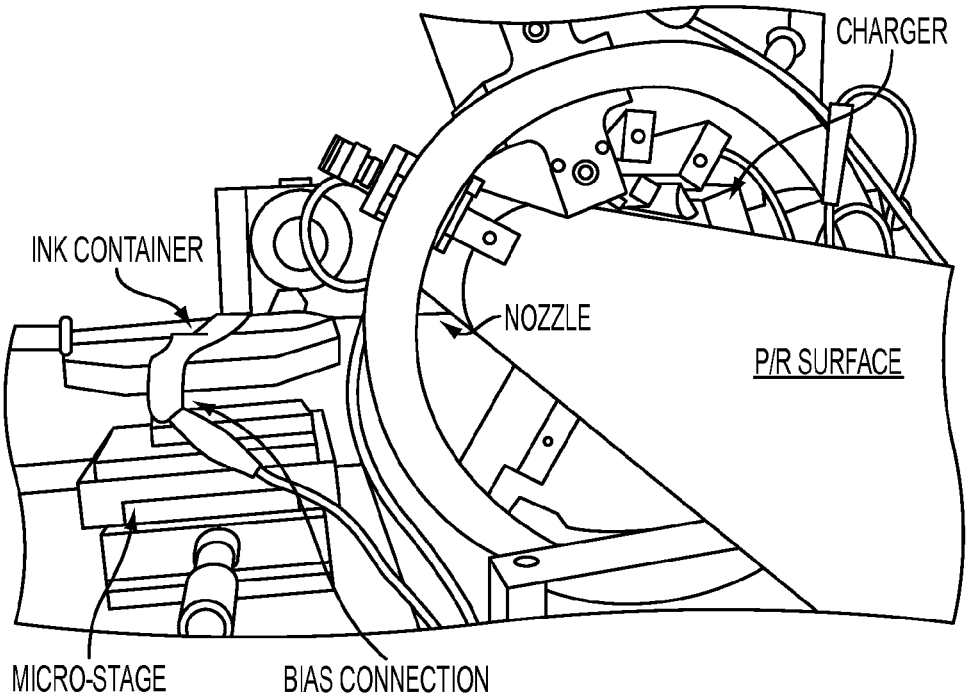
FIG. 5 is a picture of an experimental setup illustrating the processes and devices of the present disclosure.

FIG. 5 is a picture of the experimental setup. The ink container, bias connection, nozzle, photoreceptor surface, and the charger are labeled.

The silver nanoparticle ink was fed to the microcapillary tube and carefully pumped from the reservoir to the nozzle end. The microcapillary tube was placed on a micro-stage with a slight angle and with the nozzle end less than 1 mm away from an imaging member. A bias connector was used to bias the surface potential at the nozzle.

When no charges were deposited on the imaging member surface, no ink was deposited on said surface. However, after a voltage of about 700 V was applied to the imaging member surface via a scorotron charger, ink dots were observed on the imaging member surface. The ink dots had a size of about 250 μm, which is significantly smaller than the diameter of the nozzle.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

The invention claimed is:

1. An image forming apparatus comprising:

an imaging member having a charge-retentive surface;

a charging unit for applying an electrostatic charge on the charge retentive surface to a predetermined electric potential;

a light unit to discharge the electrostatic charge on the charge retentive surface to form a discharged area;

a development component to apply an ink to the charge-retentive surface to form a developed image; and a transfer component for transferring the developed image from the charge-retentive surface to another member or a copy substrate; and a voltage bias unit for adjusting an electric field between the development component and the imaging member surface;

wherein the imaging member surface is spaced apart from the development component; and wherein the development component comprises a reservoir containing the ink and a plurality of capillary openings directed towards the imaging member surface;

wherein an electrode is present at the capillary openings to provide electrical charge and form the electric field between the development component and the imaging member.

2. The apparatus of claim 1, wherein the plurality of capillary openings are located from about 10 μm to about 200 μm from the imaging member surface.

3. The apparatus of claim 1, wherein the discharged area has a lateral resolution less than 50 μm.

4. The apparatus of claim 1, wherein the capillary openings have an area in the range of from about 0.01 $\mu m^2$ to about 0.25 $mm^2$.

5. The apparatus of claim 1, wherein a printing resolution is better than 50 μm.

6. The apparatus of claim 1, wherein a printing resolution is between about 500 nm and about 500 μm.

7. The apparatus of claim 1, wherein the charging unit is in contact with the imaging member surface.

8. The apparatus of claim 1, wherein the charging unit is in semi-contact with the imaging member surface.

9. The apparatus of claim 1, wherein the charging unit is not in contact with the imaging member surface.

10. The apparatus of claim 1, wherein the electric field strength is in the range of from about 5 kV/mm to about 10 kV/mm.

11. The apparatus of claim 1, wherein the predetermined electric potential is in the range of from about 500 V to about 1 kV.

12. The apparatus of claim 1, wherein the voltage bias unit simultaneously provides DC and AC voltages.

13. The apparatus of claim 1, wherein the imaging member surface has lower surface energy than the transfer component surface of the transfer component.

14. A method for providing an ink to an imaging member surface, comprising:

forming an electrostatic latent image on an imaging member surface; and generating an electric field between the imaging member surface and a development component;

wherein the development component is not in physical contact with the imaging member surface; and wherein the development component comprises a reservoir containing the ink and a plurality of capillary openings, the ink being electrohydrodynamically delivered to the imaging member surface when the electric field is generated, and an electrode is present at the capillary openings to provide electrical charge and form the electric field between the development component and the imaging member surface.

15. The method of claim 14, wherein the plurality of capillary openings are located from about 10 μm to about 200 μm from the imaging member surface.

16. The method of claim 14, wherein the capillary openings have an area in the range of from about 0.01 $\mu m^2$ to about 0.25 $mm^2$.

17. The method of claim 14, wherein a printing resolution is better than 50 μm.

18. The method of claim 14, wherein the electric field strength is in the range of from about 5 kV/mm to about 10 kV/mm.

19. The method of claim 14, wherein the electrostatic latent image is formed by uniformly charging the imaging member surface with a charging member and selectively dissipating at least a portion of the uniformly charged surface with an image input apparatus to form the electrostatic latent image.

20. The method of claim 19, wherein the portion has a lateral resolution less than 50 μm.

* * * * *